United States Patent [19]

Hemm

[11] Patent Number: 4,993,555

[45] Date of Patent: Feb. 19, 1991

[54] PACK, COMPOSITE SHEET FOR PRODUCING A PACK, APPARATUS FOR PRODUCING THE COMPOSITE SHEET, AND PROCESS FOR PRODUCING VACUUM PACKS

[75] Inventor: Gerhard Hemm, Delmenhorst, Fed. Rep. of Germany

[73] Assignee: Jacobs Suchard AG, Zurich, Switzerland

[21] Appl. No.: 392,025

[22] Filed: Aug. 10, 1989

[30] Foreign Application Priority Data

Aug. 26, 1988 [DE] Fed. Rep. of Germany ..... 3829042

[51] Int. Cl.[5] ..... B65D 3/26

[52] U.S. Cl. ..... 206/605; 206/610

[58] Field of Search ..... 206/601, 610, 605, 608, 206/601

[56] References Cited

U.S. PATENT DOCUMENTS

| | | | |
|---|---|---|---|
| 3,318,510 | 5/1967 | Quarles, III et al. | 206/610 |
| 3,469,364 | 9/1969 | Bischoff . | |
| 4,129,214 | 12/1978 | Gendron | 206/610 |
| 4,364,478 | 12/1982 | Tuns . | |
| 4,832,505 | 5/1989 | Ausnit et al. | 206/610 |

FOREIGN PATENT DOCUMENTS

| | | |
|---|---|---|
| 0298302 | 6/1988 | European Pat. Off. . |
| 1063959 | 8/1959 | Fed. Rep. of Germany . |
| 1157995 | 11/1963 | Fed. Rep. of Germany . |
| 1946095 | 1/1966 | Fed. Rep. of Germany . |
| 1679940 | 8/1971 | Fed. Rep. of Germany . |
| 7508452 | 7/1975 | Fed. Rep. of Germany . |
| 2541382 | 12/1979 | Fed. Rep. of Germany . |
| 8528669 | 2/1986 | Fed. Rep. of Germany . |
| 8612836 | 10/1986 | Fed. Rep. of Germany . |
| 3521383 | 12/1986 | Fed. Rep. of Germany . |
| 3545731 | 7/1987 | Fed. Rep. of Germany . |
| 8801815 | 5/1988 | Fed. Rep. of Germany . |
| 3640861 | 6/1988 | Fed. Rep. of Germany . |
| 3708780 | 9/1988 | Fed. Rep. of Germany . |
| 3807469 | 1/1989 | Fed. Rep. of Germany . |
| WO86/02909 | 9/1985 | PCT Int'l Appl. . |
| 1436264 | 5/1976 | United Kingdom . |
| 1481962 | 8/1977 | United Kingdom . |

*Primary Examiner*—Joseph Man-Fu Moy

*Attorney, Agent, or Firm*—Burns, Doane, Swecker & Mathis

[57] ABSTRACT

Pack.

Packs consisting of a multilayer composite sheet are frequently used for holding aroma-sensitive commodities, particularly ground roasted coffee. The pack is composed of a central (coffee) block (10) and of fin folds projecting at both ends. In the region of the fin folds a tear-open strip (17) is provided under a closure seam (11) to facilitate the opening of the pack.

The tear-open strip (17) likewise consists of a composite sheet and is connected to the pack-composite sheet by heat sealing to ensure that there is no impairment of taste of the pack's contents while at the same time guaranteeing a high-strength connection.

15 Claims, 7 Drawing Sheets

Fig. 9
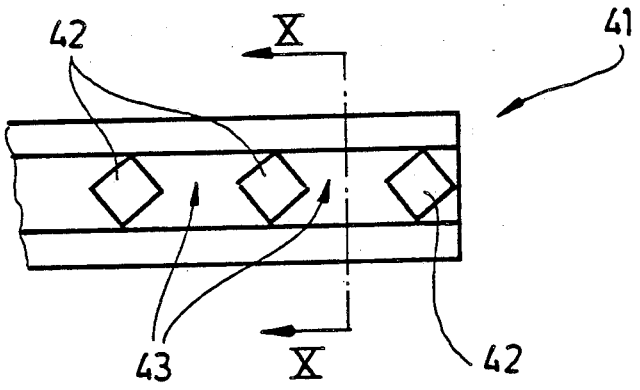
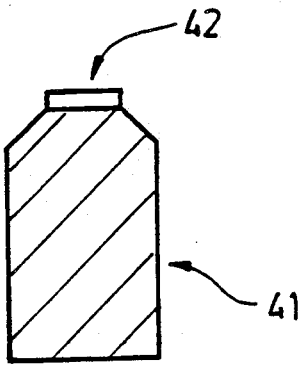
Fig. 10

PACK, COMPOSITE SHEET FOR PRODUCING A PACK, APPARATUS FOR PRODUCING THE COMPOSITE SHEET, AND PROCESS FOR PRODUCING VACUUM PACKS

DESCRIPTION

The invention relates to a pack according to the generic part of patent claim 1, a composite sheet according to the generic part of patent claim 6, an apparatus for producing the composite sheet, and also a process for producing vacuum packs according to the generic part of patent claim 13.

For packs of this kind, tear-open aids are known which consist of a tear-open strip, fixed to the sheet (U.S. Pat. No. 4,364,478). The strip is connected over its entire length with the pack sheet. With this kind of application of the tear-open strip, a warping of the sheet in and/or near the connecting region occurs, which in turn leads to the sheet becoming jammed or damaged in the appropriate machines for the subsequent process steps. With the high cycle rates demanded of packaging machines nowadays, this leads to considerable malfunctioning which involves high costs.

In an older application (P 38 07 469.9) by the same applicant, the contents of which is expressly referred to herewith and made the subject of the present application, a vacuum pack of the type named at the outset is known, whereby an end (gripping end) of the tear-open strip facing the grip tab ends or is disposed at such a distance from the punch cuts as to ensure the leaktightness of the welded composite sheet (side weld).

In the above mentioned older application the proposal is made to join the tear-open strip to the inner side of the composite sheet by means of adhesive bonding. This type of connection, however, is attended by the danger that solvent remnants or the adhesive itself evaporates, and consequently the especially important neutral taste is not ensured. The strength of the connection is of special importance as well, because the tearing open of the pack's composite sheet must be reliable for the consumer so that he does not suddenly during opening, after initial success, have the detached tear-open strip in one hand and the half-open pack in the other. Therefore, a connection between the tear-open strip and the composite sheet produced by adhesive bonding is out of the question.

The object of the present invention is to develop a pack of the type mentioned at the outset such that trouble-free handling of the same is guaranteed in the further course of the packaging process.

To achieve this object, the tear-open strip is sealed with the pack-composite sheet via spot seals with breaks in the sealing as viewed in the longitudinal direction of the same.

It has been shown that in the case of an intermittent connection between the tear-open strip and the pack-composite sheet, constructed in this way, no warping occurs in the pack sheet. Therefore, the packaging machines can operate at a higher speed and the production process, as a whole, can be organized more efficiently.

Moreover, sealing only in spots causes energy consumption to be greatly reduced.

Advantageously, the tear-open strip is likewise composed of a composite sheet with a sealable external layer via which the tear-open strip is connected to the pack-composite sheet by spot sealing, whereby the two sealable layers are superimposed on one another. In this manner, an especially high degree of tensile strength of the tear-open strip is ensured. Secondly, an especially good heat distribution is obtained during sealing which results in an especially reliable connection of the two thermoplastic layers with one another. The connection itself is neutral in taste and highly durable.

As the teaching just described is also suitable for producing other kinds of packs which are to comprise a highly durable tear-open strip, neutral in taste, the invention likewise relates to a composite sheet of the type mentioned at the outset with tear-open strips applied to it.

A sealing jaw is suitable for producing such a composite sheet. The heatable sealing face of this jaw can be pressed onto a tear-open strip to be sealed and is provided with indentations such that in the longitudinal direction of the sealing jaws there are a plurality of single-seal faces in a row, separated from one another by indentations. This kind of an apparatus guarantees that only spot seals are formed and that the pack sheet remains warp-free as a result so that said sheet can be worked more easily in the appropriate packaging machines.

The invention also relates to a process for producing a vacuum pack of the type mentioned at the outset, whereby after the upper region has been widened and the fin fold has been formed, the fin fold is sealed section-wise in the edge regions and also in a center region in an intermediate step such that unsealed residual-opening sections in fact remain, via which the air can be evacuated from the pack, but the remaining opening is essentially retained collapsed (not gaping) with the composite sheet's inner surfaces superimposed on one another. This is especially important for the final attachment of the closure seam, because first, the air is evacuated through the still-open pack, whereby the opening in the pack would gape in the previously customary process. Then, in the subsequent attachment of the closure seam wrinkles would form, and as a result, leakage would occur which would lead to rejects. As a result of sealing in the center region, this is now reliably avoided.

Further features essential to the invention are shown in the dependent claims and also in the following description of preferred embodiments of the invention which are described more fully with reference to the illustrations, in which:

FIG. 9 shows a sealing jaw in accordance with a preferred embodiment of the invention, in plan view; and FIG. 10 shows a section along line X—X from FIG. 9.

Figure 1:
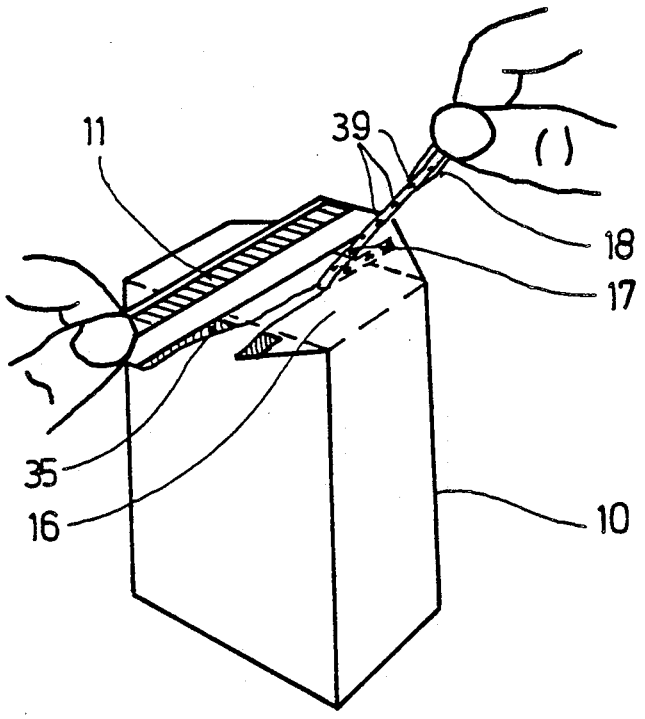
FIG. 1 shows in perspective a filled pack in the opening operation.

The packs presented in the drawings as embodiments are vacuum packs for receiving ground roasted coffee. The basic structure of a vacuum pack of this kind comprises an outer wrapping (not shown) of paper, cardboard, or the like, and an inner packing constituting the actual vacuum pack. The latter consists of a portion of a tube of a multilayer, aroma-tight and airtight composite sheet, the construction of which is described more fully below.

For the production of the vacuum pack in a manner known per se, a continuous sheet tube having a seam extending in its longitudinal direction is first formed. Individual tube portions are cut off from this sheet tube, each being used to form a vacuum pack. After a bottom, transversely directed closure seam (not shown) has been made by thermal welding or sealing, the resulting bag is filled and then evacuated. During the evacuation the contents of the pack (ground roasted coffee) is formed into a cuboidal block, namely a coffee block 10, by appropriate external shaping means (not shown). This block is solid and stable in respect of shape because of the vacuum inside the pack. The top end of the tubular pack is now leaktightly closed by a transversely directed closure seam 11, this being achieved with the aid of appropriate known heat-sealing jaws (not shown). In the preferred embodiments shown in FIGS. 6 and 7, side part seams 12, 12' and also a fixing seam 13 situated between them are first formed so that the slightly gaping opening, created at first and situated between the side part seams 12, 12', is held via the fixing seam 13 in a collapsed state. Air can be sucked off through the two partial openings, though, during the evacuation operation. The closure seam 11 extending over the entire width is then formed.

The pack constructed in this manner forms a fin fold 14 projecting from the coffee block 10 in the regions above and below said block. This fold consists of a rectangular end closure portion 15 and of an adjoining trapeziform transition portion 16. The latter merges into the cuboidal region of the coffee block 10. The closure seam 11 is located in the region of the rectangular closure portion 15, namely directly adjoining the free opening edge.

In the finished pack those portions of the fin fold 14 which project beyond the coffee block 10 are folded against the top and bottom end faces of the coffee block 10, so that a structure having a cuboidal overall shape is formed, which is placed inside an outer wrapping in the described manner.

To open the airtightly closed pack, that is, to tear open the composite sheet, a tear-open strip 17 is provided, transversely to the sheet tube and the longitudinal axis of the coffee block 10 in the region of the fin fold 14. This strip is disposed on the inner side of the composite sheet. The tear-open strip 17 is expediently already disposed on the continuous undivided web of composite sheet, that is before the formation of the sheet tube, in fact in a relative position corresponding to the position inside the pack.

On one side of the pack or at one end of the tear-open strip 17, said strip forms a gripping end 18 in which region a grip tab 19 is formed out of the material of the composite sheet. This grip tab 19 is situated in such a position relative to the tear-open strip 17, that is the gripping end 18 of the latter, that the tear-open strip composite sheet can be slit open over the length of the tear-open strip 17.

The gripping end 18 and the grip tab 19 are situated in the region of a planar weld joint of sheet walls lying opposite one another, in the region of the closure portion 15 or of the transition portion 16. This side weld 20 especially serves to maintain leaktightness, and secondly it forms a stiffening region assisting the initial phase of the operation of tearing open the pack. This is especially the case in the embodiment according to FIG. 7, in which the gripping end 18 of the tear-open strip 17 is not drawn into the grip tab 19 but rather ends before said tab.

In all the embodiments of the invention the grip tab 19 is defined by punch cuts 27, 28 and 29. The relative positions of the gripping end 18 and the grip tab 19, on the one hand, and the punch cuts on the other hand are important to achieve an adequate spacing between the punch cuts and the tear-open strip ensuring leaktightness.

This spacing should amount to 4 mm or more. This is especially easy to achieve in the embodiment of the invention shown in FIG. 7, because here the gripping end 18 of the tear-open strip 17, is not inserted into the grip tab 19. However, as a result of the fact that the upper and lower punch cuts 27, 28, running parallel to the tear-open strip 17, already indicate a tearing direction, it is ensured that a sufficiently large portion of the tear-open strip 17 is grasped together with the stiffened region 20, when pulling the grip tab 19. Of course, a V-shaped or semicircular punch cut can be made instead of the U-shaped punch cut 26. It is essential, however, that the grip tab 19 lies flat inside the region 20 to begin with, so that the consumer can easily push it out and grasp it. The remaining web of material 30–32 encircling the U-shaped punch cut 26 then remains so that the consumer can grasp said web with the other hand and thus further facilitate the opening operation.

Figure 2:
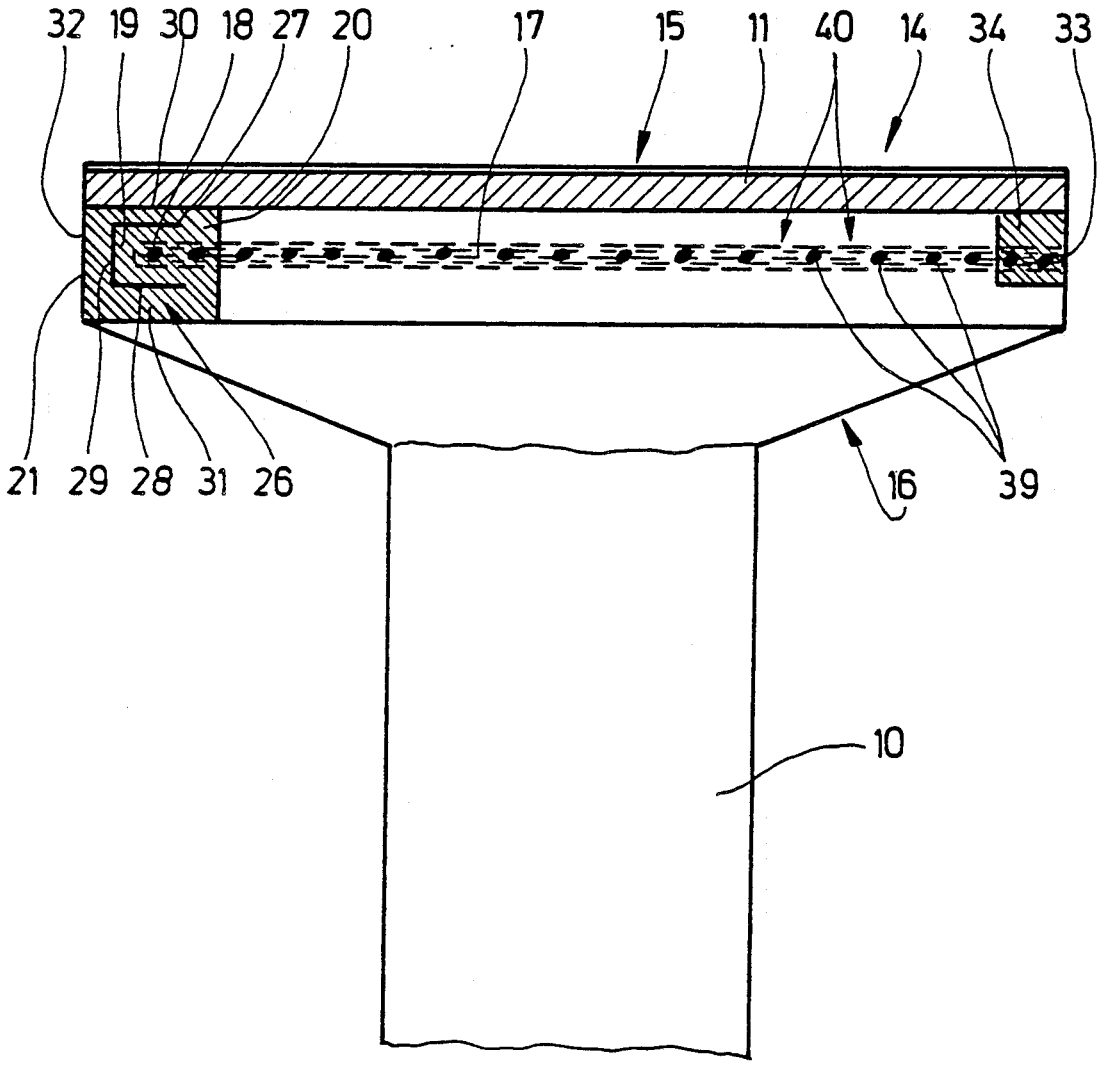
FIG. 2 shows a closed pack with fins unfolded in accordance with a first preferred embodiment of the invention, in plan view.
Figure 6:
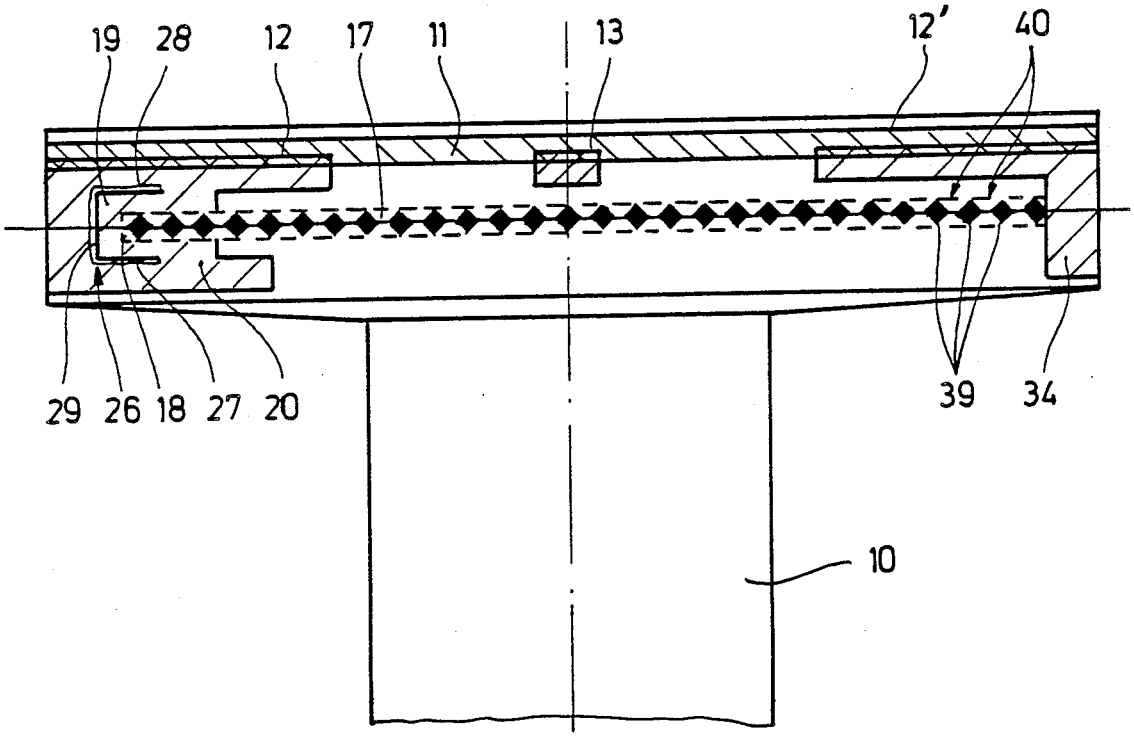
FIGS. 6 to 8 shows three further preferred embodiments of the invention, in views similar to FIG. 2.
Figure 7:
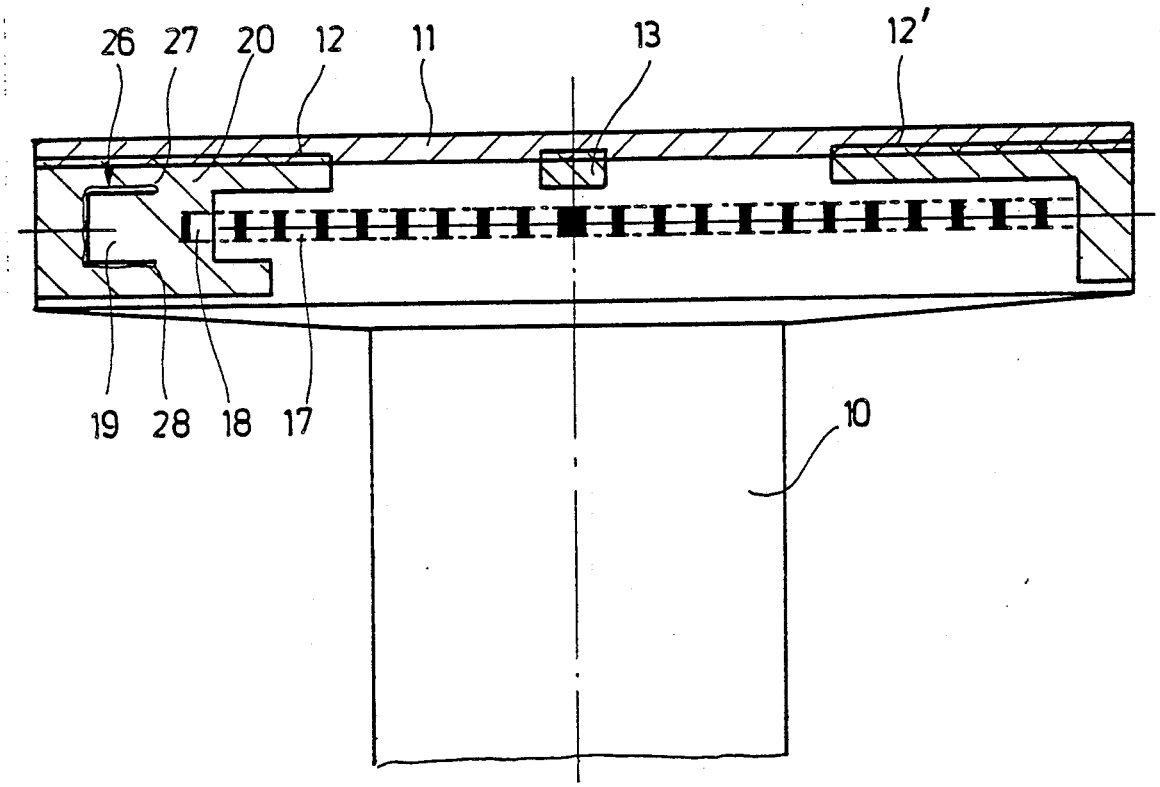
Figure 8:
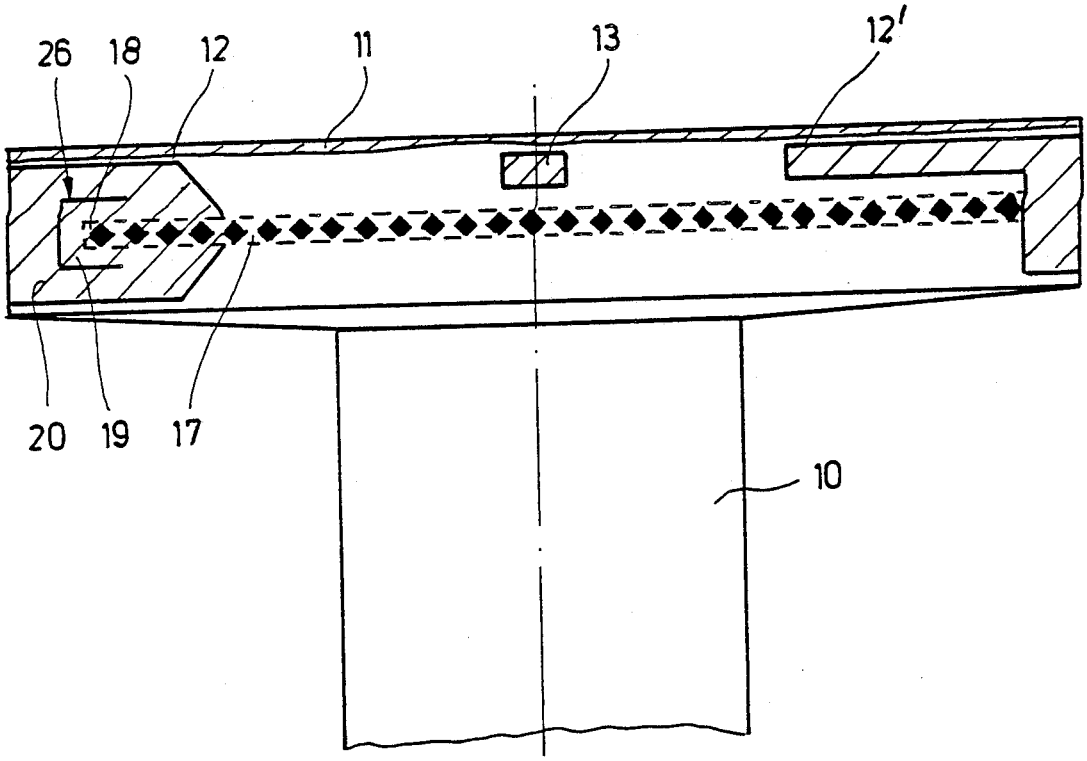

The leaktightness of the arrangements according to FIGS. 6 to 8 is increased over that according to FIG. 2, because the tear-open strip 17 ends before the end weld 34 in the region of the side edge.

The side weld 20 shown in FIG. 8 comprises an inner edge directed arrow-shaped towards the tear-open strip 17, whereby this shape ensures that in the opening operation the upper and lower tear in the composite sheet, i.e. in the region 20, converges towards the tear-open strip 17.

The pack-composite sheet which has been provided with a tear-open strip is described more fully below with reference to FIGS. 3 to 5.

To produce a sheet tube, that is the pack resulting therefrom, a pack-composite sheet 32 is provided with tear-open strips 17. These tear-open strips 17 are also composed of a composite sheet which consists of a layer of aluminium foil 24, a polyester layer 25 and a sealable layer 23 which comprises a thermoplastic material, particularly heat-sealable polyethylene of low density. The composite sheet 22 for the tear-open strip 17 is preferably composed of an aluminium layer 7 $\mu$ thick, a polyester layer approximately 12 $\mu$ thick and a polyethylene layer approximately 100 $\mu$ thick. This sheet is cut into strips of suitable width and length and is welded onto a continuous web of pack-composite sheet 32. The pack-composite sheet 32 is composed of an external (on the finished pack) polyester layer 36, an aluminium foil 37, and an inside layer 38 made of heat-sealable material, particularly heat-sealable polyethylene of low density. Preferably, the external polyester layer is approximately 12 $\mu$ thick, the aluminium foil approximately 9 $\mu$ thick, and the inside, heat-sealable polyethylene layer 38 is approximately 70 $\mu$ thick. The bonding of the layers is effected preferably via a setting polyurethane bonding agent.

The tear-open strips 17 are sealed or welded onto the pack-composite sheet 32, in fact by means of suitable spot-heating and simultaneous application of pressure. This results in a fusion of the two heat-sealable layers 23 and 38, as suggested in FIG. 4 by a break in the dividing line between the two layers. The connection thus created holds no danger of giving off vapours which could be detrimental to taste or even have a poisonous effect, because no further material is used other than polyethylene which is neutral in taste, anyway. Furthermore, the connection is exceptionally strong so that the tear-open strip 17 cannot tear off in the opening operation. The easy welding of the composite sheet 22 forming the tear-open strip 17 to the pack-composite sheet 32 is facilitated in that the metal layer, particularly aluminium layer 24, distributes the heat introduced by the heat-sealing tools or jaws quickly and evenly over the material.

Figure 3:
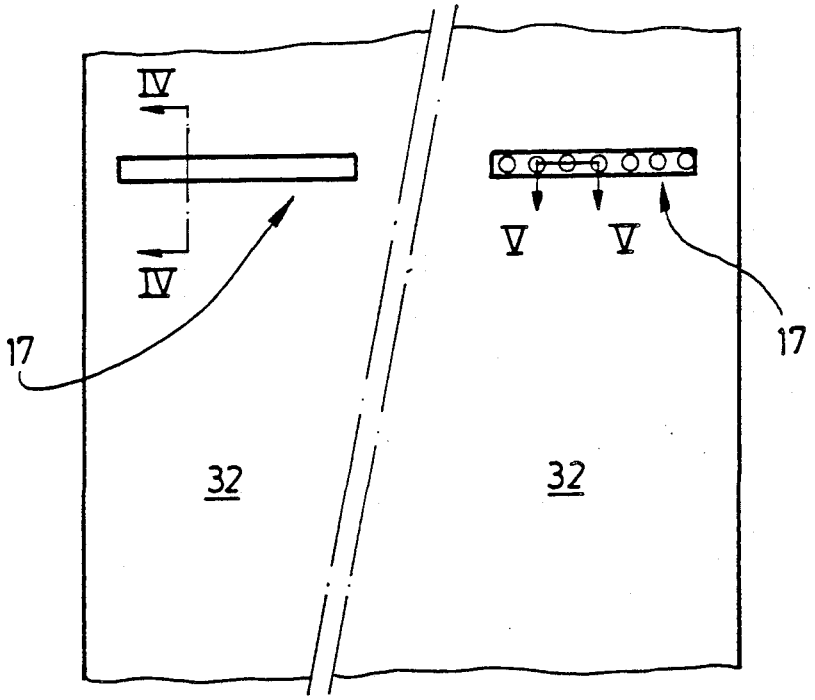
FIG. 3 shows two different embodiments of the invention relating to a pack-sheet provided with a tear-open strip, in plan view.
Figure 5:
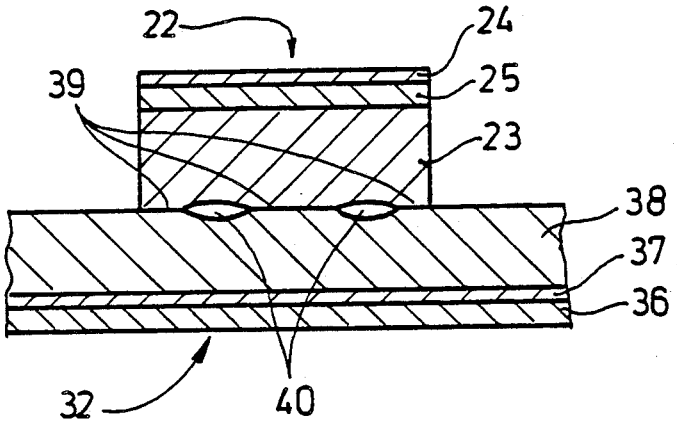
FIGS. 4 and 5 shows sections along lines IV—IV and V—V from FIG. 3.
Figure 4:
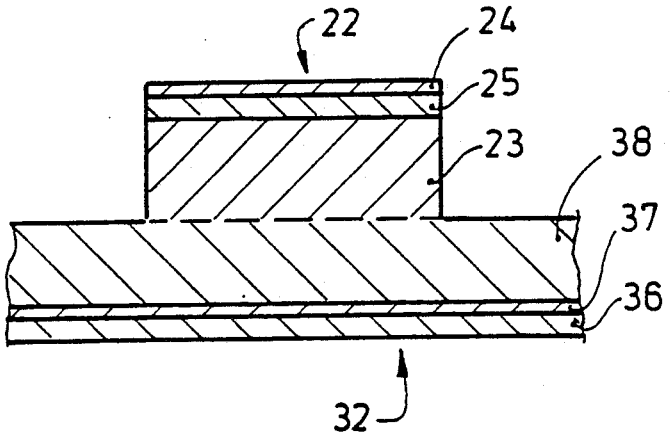

This kind of dotted connection between the tear-open strip 17 and the pack sheet 32 shown in FIG. 3, right, and FIG. 5, in section, is particularly preferred. Namely, it has been shown surprisingly that a continuous weld (FIG. 3, left) between the composite sheet 32 for the tear-open strip 17 and the pack-composite sheet 32 leads to warping of the pack sheet 32 in the region of the tear-open strip 17. On the other hand, such warping does not occur, surprisingly, when merely spot seals 39 alternating with breaks 40 are provided so that the tear-open strip 17 is actually only connected or welded over approximately half its length to the pack-composite sheet 32. Although this connection is not continuous, it has shown a practically unreduced durability. It appears that due to the recesses 40 the tension created during welding can be equalized, and as a result, the warping of the composite sheet 32 described above, which is very critical for the manufacturing machines, is avoided.

To produce such a composite sheet 32 with a tear-open strip 17 sealed on, a sealing jaw as schematically illustrated in FIGS. 9 and 10 is suitable. These illustrations show that the sealing jaw 41 comprises a heatable body which bears seal faces 42 at one of its ends. These seal faces 42 are separated from one another via indentations 43. This arrangement guarantees that spot seals 39 are created at points at which the seal faces 42 are set onto the sheets, whereas no sealing takes place in the region of the indentations 43 lying between the seal faces 42 so that the aforementioned breaks 40 in the connection between the two sheets appear which lead to the desired equalization of tension.

In the embodiment shown in FIG. 9, the seal faces 42 have a rhombic construction and approximately the same width in the longitudinal direction of the seal jaw 41 as the indentations 43 lying between them. In another preferred embodiment of the seal jaw 41 according to the invention, the single-seal faces 42 have a round or rectangular shape. The results to be achieved with this kind of a seal jaw are shown in FIGS. 2 and 3 and also 7.

The width of the indentations 43 (as seen in the longitudinal direction of the seal jaws 41) is selected such that the above mentioned tensions can be equalized. Preferably, the width of the indentations 43 should amount to only approximately one half to twice the corresponding width of the faces 42.

The single-seal faces 42 are evenly spaced—as seen in the longitudinal direction of the seal jaws 41. Accordingly, an even spacing of the individual spot seals 39 is provided in the longitudinal direction of the tear-open strip 17.

I claim:

1. Pack consisting of a tube of multilayer composite sheet having at least one sealable (thermoplastic) external layer, for pourable products, particularly (ground) roasted coffee, formed into a (cuboidal) coffee block which is stable in respect of shape, whereby a sealable tear-open strip is provided, extending at least in a partial region of the pack and up to or into the region of a grip tab, characterized in that the tear-open strip (17) is sealed via spot seals (39) with breaks (40) in the sealing—viewed in the longitudinal direction of the tear-open strip—to the pack-composite sheet (32).

2. Pack according to claim 1, characterized in that the tear-open strip (17) is composed of a composite sheet (22) which comprises, as does the pack-composite sheet (32), a sealable, preferably thermoplastic, external layer (23) via which the tear-open strip (17) is connected to the pack-composite sheet (32) by spot sealing, whereby the two sealable layers (23, 38) are superimposed on one another.

3. Pack according to claim 2, characterized in that—viewed in the longitudinal direction of the tear-open strip (17)—the spot seals (39) are provided in an approximately even spacing and particularly the lengths of the spot seals (39) have the same magnitude as the breaks (40), preferably amounting to one half to twice the length.

4. Pack according to claim 3, characterized in that the width of the spot seals (39) is essentially equivalent to that of the tear-open strip (17).

5. Pack according to claim 4, characterized in that the spot seals (39) are round, rhombic, and especially rectangular.

6. Composite sheet with at least one external sealable layer for the production of packs with tear-open strips, particularly for the production of packs according to claim 5, characterized in that the tear-open strip (17) is sealed via spot seals (39) with breaks (40) in the sealing—viewed in the longitudinal direction of the tear-open strip—to the composite sheet (32).

7. Composite sheet according to claim 6, characterized in that the tear-open strip (17) likewise consists of a composite sheet (22) with an external sealable layer (23) and that the tear-open strip (17) with superimposed, sealable layers (23, 38) is spot sealed to the sealable layer (38) of the composite sheet (32).

8. Composite sheet according to claim 7, characterized in that—viewed in the longitudinal direction of the tear-open strip (17)—the spot seals are provided in an approximately even spacing and particularly the lengths of the spot seals (39) have the same magnitude as the breaks (40), preferably amounting to one half to twice the length.

9. Composite sheet according to claim 8, characterized in that the width of the spot seals (39) is essentially equivalent to that of the tear-open strip (17).

10. Pack according to claim 1, characterized in that—viewed in the longitudinal direction of the tear-open strip (17)—the spot seals (39) are provided in an approximately even spacing and particularly the lengths of the spot seals (39) have the same magnitude as the breaks (40), preferably amounting to one half to twice the length.

11. Pack according to claim 1, characterized in that the width of the spot seals (39) is essentially equivalent to that of the tear-open strip (17).

12. Pack according to claim 1, characterized in that the spot seals (39) are round, rhombic, and especially rectangular.

13. Composite sheet with at least one external sealable layer for the production of packs with tear-open strips, particularly for the production of packs according to claim 1, characterized in that the tear-open strip (17) is sealed via spot seals (39) with breaks (40) in the sealing—viewed in the longitudinal direction of the tear-open strip—to the composite sheet (32).

14. Composite sheet according to claim 6, characterized in that—viewed in the longitudinal direction of the tear-open strip (17)—the spot seals are provided in an approximately even spacing and particularly the lengths of the spot seals (39) have the same magnitude as the breaks (40), preferably amounting to one half to twice the length.

15. Composite sheet according to claim 6, characterized in that the width of the spot seals (39) is essentially equivalent to that of the tear-open strip (17).

* * * * *